United States Patent [19]

Alsip

[11] Patent Number: 4,585,234

[45] Date of Patent: Apr. 29, 1986

[54] MULTI-DIMENSIONAL GAME

[76] Inventor: Bruce F. Alsip, 2310 Upper Farm Rd., Bainbridge Island, Wash. 98110

[21] Appl. No.: 704,298

[22] Filed: Feb. 22, 1985

[51] Int. Cl.[4] ..... A63F 3/00

[52] U.S. Cl. ..... 273/271; 273/273

[58] Field of Search ..... 273/241, 271, 273, 290

[56] References Cited

U.S. PATENT DOCUMENTS

| | | | |
|---|---|---|---|
| 680,324 | 8/1901 | Gedge | 273/273 X |
| 3,181,867 | 5/1965 | Dreyer | 273/273 X |
| 3,464,701 | 9/1969 | Mahoney | 273/241 |
| 4,067,576 | 1/1978 | Balas | 273/273 X |
| 4,232,864 | 11/1980 | Yaworsky | 273/241 |

FOREIGN PATENT DOCUMENTS

| | | | |
|---|---|---|---|
| 1160120 | 7/1969 | United Kingdom | 273/241 |

*Primary Examiner*—Harland S. Skogquist

*Attorney, Agent, or Firm*—Jensen & Puntigam

[57] ABSTRACT

A multi-dimensional game wherein a player takes successive turns without being able to see the result of previous plays. The game comprises a substantially rectangular flat base portion having an upstanding central tower portion, transverse of the base portion and intermediate the length. A plurality of marker receiving vertical bores extend through the tower. A tray member including a plurality of sets of bores, each set being alignable with the bores of the tower allow capture of the markers one row at a time for scoring.

2 Claims, 5 Drawing Figures

MULTI-DIMENSIONAL GAME

DESCRIPTION

1. Technical Fields

This invention relates to a three dimensional game of skill which requires a player to take his turn without being able to see the results of the previous play or plays. The scoring is based upon the relative placement of successive playing pieces.

2. Background Art

Games, to have lasting value and ongoing use, must provide sufficient variety to maintain interest and sufficient challenge to spark competitiveness.

The present game, because of its configuration and means of scoring, accomplishes the two requirements in a unique structural fashion. The player, without being able to see the result of previous plays, must locate his piece in a three dimensional container in a position which will cause a score. The container confines successive pieces to a vertical stack but the choice of which one of the multiple columns available is used by a player during his turn is dictated by chance or memory.

The pieces are removed from the container for scoring one layer at a time simultaneously from the bottom of each stack and the score is generated by a plurality of identical adjacent playing pieces.

The strategy then, is to remember the order in which the markers have been played to maximize the number of pieces lying in a straight line in a resultant scoring plane while simultaneously preventing the opponent from accomplishing the same goal.

Prior art games known to the inventor which utilize multi-dimensional strategies include:

U.S. Pat. No. 680324 granted to Gedge Aug. 13, 1901 which discloses a three-dimensional block with vertical bores into which flat distinguishable playing pieces are sequentially placed. The bottom of the block is hinged and has receiving cups such that the main portion of the block may be raised to determine the order in which the pieces have been played by the relative position in the stack.

U.S. Pat. No. 3,464,701 granted Sept. 2, 1969 to Mahoney discloses a three-dimensional tic-tac-toe game having a plurality of individual removable playing boards which are held in vertical alignment within a cube allowing three dimensional play.

U.S. Pat. No. 3,508,753 granted Apr. 28, 1970 to Mackey discloses a board game wherein the upper surface represents the surface of the water and the lower surface represents submerged areas permitting a war-type game including ships, depth charges, submarines and torpedos.

U.S. Pat. No. 4,232,864 granted to Yaworsky Nov. 11, 1980 which discloses a three dimensional game apparatus wherein a minimum of two identical playing surfaces are superimposed during play. The playing pieces and the playing surfaces are partially transparent to permit observation of the location of the playing pieces during play.

DISCLOSURE OF THE INVENTION

The present invention contemplates a game of strategy wherein the playing pieces are played, in turn, by opposing players without the ability to see the location of the pieces which have been played previously.

The game apparatus, of a solid material, has a plurality of vertical bores. Though the game is played in the vertical mode, i.e. one playing piece is stacked upon a previously played piece in the same bore, the scoring is in accord with pieces in a line in the horizontal scoring plane. Means is provided to remove the pieces from the apparatus one horizontal row at a time.

The players of the game need to either block the scoring of an opponent or, in the alternative, play to score themselves, either strategy requires that memory be utilized as to whose piece was last played in which bore and how many had been played previously i.e. into which layer and resultant scoring row, the next piece in a given column or bore will go.

With the above noted prior art in mind, it is an object of the present invention to provide a multidimensional game requiring strategy, skill and memory.

Another object of the present invention is to provide a game which is three dimensional in strategy and yet simple of construction. The game apparatus allows sequential non-destructive access to individual levels or layers of the playing pieces to accommodate scoring by layer.

Yet another object of the present invention is to provide a means for removing an individual layer from multiple stacks of game pieces without disturbing the vertical or horizontal ordering of the remaining game pieces.

BEST MODE FOR CARRYING OUT THE INVENTION

Figure 1:
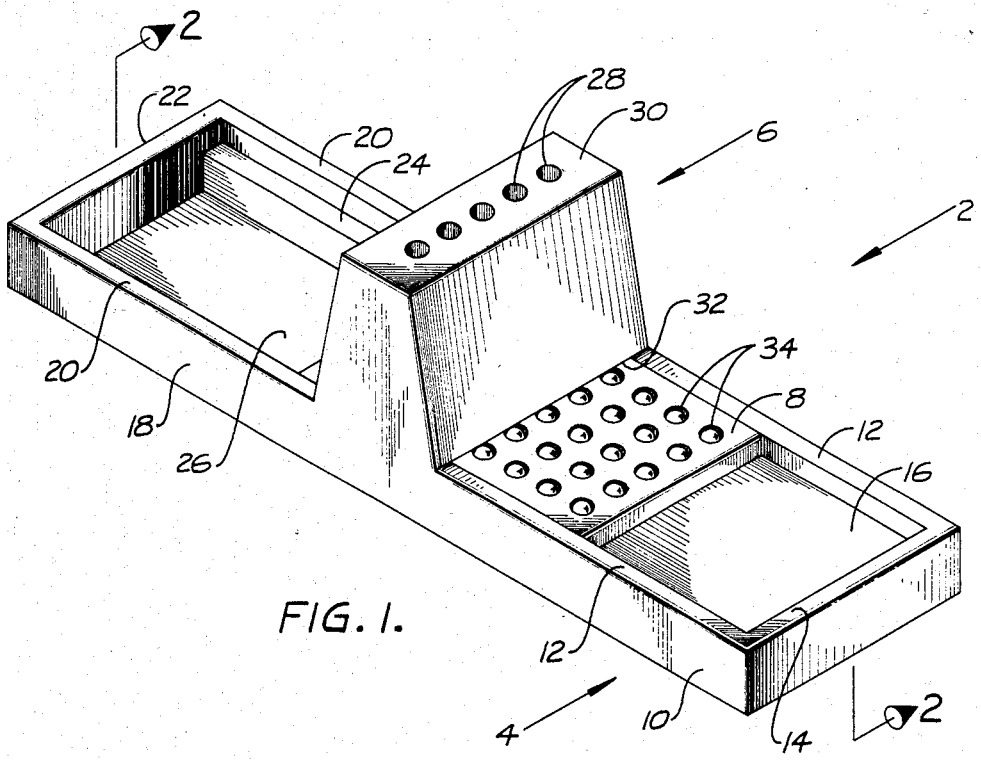
FIG. 1 discloses a pictorial representation of the present inventive game.

As seen in FIG. 1, the game contemplates a three dimensional game apparatus 2 having a rectangular elongated base member 4 having an upstanding centrally located tower 6 and a slide member 8.

As seen in this view, the base portion 4 includes a first end 10 having a pair of parallel upstanding side walls 12, an upstanding end wall 14 and as to be more clearly pointed out hereinafter, a flat recessed upper surface 16. The second end of the base member 4 denoted as 18 includes a pair of upstanding parallel side walls 20, an upstanding end wall 22, a pair of inwardly projecting side rails 24 (only one to be seen in this view) and an upwardly facing bottom surface 26 which is in a plane below the plane of surface 16.

Centrally located on the base member 4 is an upstanding tower 6 which may be of any configuration but includes a plurality of vertical bores 28 extending the height of the tower from the upper surface 30 to the bottom surface 32.

Slide 8 is captured between the side rails 12—12, 20—20 and end rails 14–22 and is movable horizontally along the length of the base member 4 passing beneath the tower 6. Slide 8 has a plurality of sets of bores 34 each set of which is capable of being aligned with the bores 28 as will be explained hereinafter.

Figure 2:
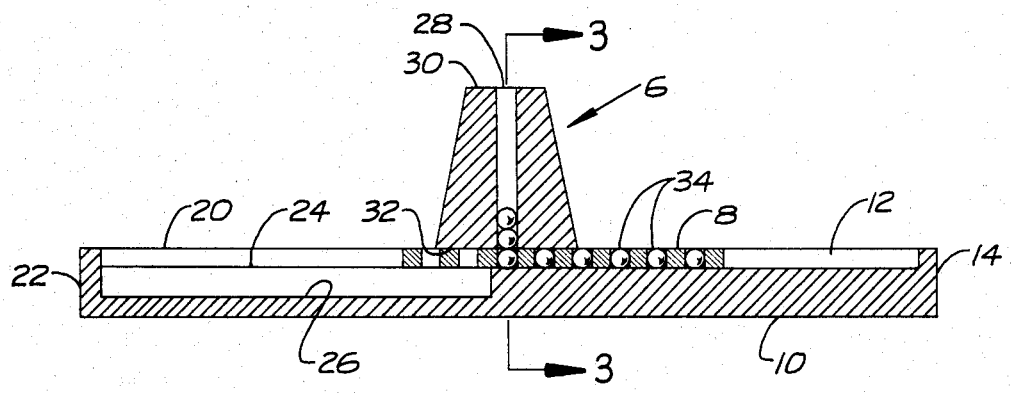
FIG. 2 is a vertical section of the game along lines 2—2 of FIG. 1.
Figure 3:
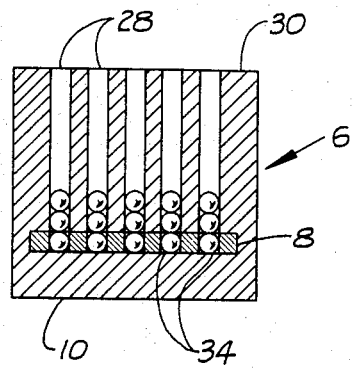
FIG. 3 is a vertical section of the game along lines 3—3 of FIG. 2.

As seen in FIG. 2, which includes the same numerals identified identical parts, slide 8 is movable horizontally beneath tower 6 and as it is moved to the right as seen in this view, markers which may be in the form of marbles, pass down through the bores 28 and become temporarily located in the bores 34. Referring now to FIG. 3, it can be seen that in the preferred embodiment there are five horizontal bores 28 within the tower 6 which for scoring purposes are sequentially aligned with the bores 34 in the slide 8, removing the markers stacked in the bores 28 one layer at a time.

Figure 4:
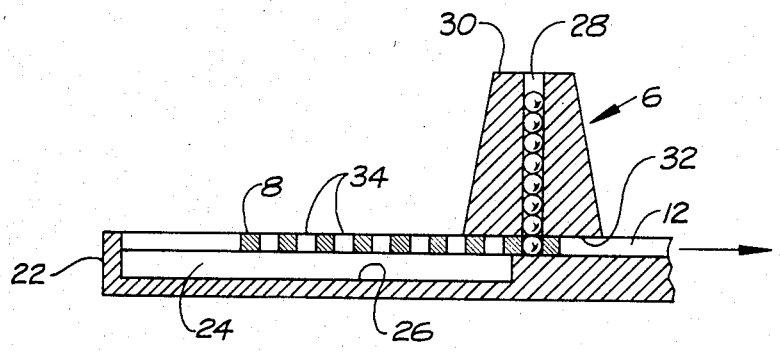
FIG. 4 is a partial vertical section along lines 2—2 showing the relative position of the apparatus at the beginning of play.

FIG. 4 depicts the game at the end of play but just prior to scoring. With the game apparatus in this position, each player in turn deposits his or her marker in one of the columns 28. The first marker in each column 28 falls within the rightwardmost bore 34 of slide 8 which is in alignment therewith. As each player in turn deposits his marker, the columns become full. In the preferred embodiment, each column will hold 8 markers and thus as is readily apparent, the number of bores 34 located longitudinally in slide 8 will likewise equal 8.

To score, the players take slide 8 and move it sequentially to the right capturing in sequence each horizontal row of markers within the column 28 of tower 30.

Figure 5:
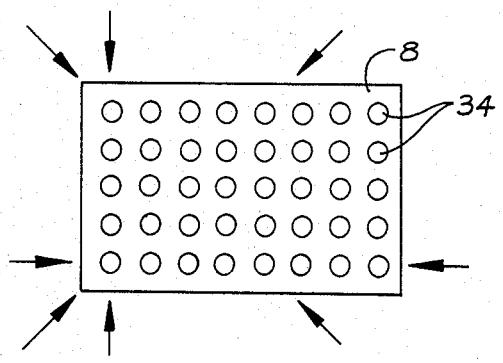
FIG. 5 is a plan view of the slide depicting the possibilities for scoring.

When all of the markers have been deposited within the tray 8, then the players will score depending upon the number of adjacent identically denoted markers. To score, identical markers will be counted if they are in rows as designated by the arrows in FIG. 5, it being understood that the arrows are representative only and that multiple identical rows can readily be identified and scored.

Following the scoring of the game, the slide 8 is moved to the left depositing the markers within the depressed receiving area 26. To commence another game, the markers are removed and play again begins with the slide 8 as is shown in FIG. 4. Thus, as can be seen, the present invention contemplates a game wherein the players need not only to remember the particular location of the previously placed markers but also that they will be scored in a different dimension thus increasing the complexity of the game.

I claim:

1. A game comprising:

an elongated rectangular base portion including an upwardly extending transverse tower portion at the midpoint thereof, said base portion comprising a first end having a substantially flat upper surface and a second and forming a dish-like receptacle having its upper surface in a plane below the plane of the upper surface of the first end, said transverse tower portion including a plurality of vertical bores across the width thereof and extending from the top thereof to the bottom thereof, said bottom being in a plane above the plane of the upper surface of the first end, tray means having a plurality of bores arranged in rows, each row capable of being aligned with the bores of the tower, said tray means being movable incrementally beneath the tower portion whereby markers in the bores in the tower will fall into the bores in the tray means upon alignment therewith and the markers will fall into the receptacle when the tray overlies the second end.

2. A game as in claim 1, wherein the tray is captured between side rails and end rails at the ends of the base portion and the bottom surface of the tower portion.

* * * * *